US005700521A

United States Patent [19]

Horikiri

[11] Patent Number: 5,700,521

[45] Date of Patent: Dec. 23, 1997

[54] METHOD OF PRODUCING A DECORATIVE PLATE

[75] Inventor: Yataro Horikiri, Tokyo, Japan

[73] Assignee: Sakura Hobby Craft Co., Ltd., Tokyo, Japan

[21] Appl. No.: 576,977

[22] Filed: Dec. 22, 1995

[30] Foreign Application Priority Data

Aug. 2, 1995 [JP] Japan ..... 7-197582

[51] Int. Cl.[6] ..... B05D 1/38; B05D 5/00

[52] U.S. Cl. ..... 427/258; 427/265; 427/407.1; 427/417

[58] Field of Search ..... 427/258, 265, 427/288, 277, 411, 412, 417, 407.1, 379; 434/84

[56] References Cited

U.S. PATENT DOCUMENTS

| | | | |
|---|---|---|---|
| 4,578,131 | 3/1986 | Hawkins, Jr. | 156/62 |
| 4,826,907 | 5/1989 | Murao et al. | 524/394 |
| 5,612,397 | 3/1997 | Gebhard et al. | 524/35 |

FOREIGN PATENT DOCUMENTS

| | | | |
|---|---|---|---|
| 198887 | 6/1923 | United Kingdom | 427/265 |

*Primary Examiner*—Shrive P. Beck
*Assistant Examiner*—Fred J. Parker
*Attorney, Agent, or Firm*—Keck, Mahin & Cate

[57] ABSTRACT

There is provided a method of producing a decorative plate which can be made quite easily without any danger of damage to user's skin. The method comprises the steps of:

preparing a base plate having thereon a predetermined design, applying a water-based acrylic paint (water paint of acrylic resin) along a predetermined design to thereby expand the design three-dimensionally, permitting the coated paint to become cured to form a first transparent film portion, applying a water-based acrylic paint on the cured transparent film to thereby further expand the film portion three-dimensionally, and permitting the expanded film portion to become cured to form a second transparent film portion so that a shrinkage of the first transparent film is compensated by the film portion of the second transparent film.

2 Claims, 1 Drawing Sheet

METHOD OF PRODUCING A DECORATIVE PLATE

BACKGROUND OF THE INVENTION

1. The Field of the Invention

The present invention relates to a decorative plate which is produced by applying paint on a base plate such as paper, cloth, fabric, photograph, etc. so as to provide an effective three-dimensional appearance of a predetermined design.

2. Description of the Prior Art

In a conventional method of producing a decorative plate of the type described above, epoxy resin paint has been used to apply the same to the base plate.

The conventional production method described above, however, has some trouble and difficulties that since the epoxy resin paint is prepared by dissolving epoxy resin in an organic solvent, physical contact with the epoxy resin paint results in troubles and difficulties in users' skins and eyesight, and in the most serious case, loss of eyesight.

In case that two-pack type epoxy resin paint is used, it is necessary to mix constantly the two-pack materials (chief material and hardening agent) in a predetermined ratio and, therefore, the preparation of the material must be made by experts. Further, since the viscosity of the mixture of the two-pack type epoxy resin paint becomes greater with age and, therefore, there is a time restriction that coating must be carried out within a predetermined limited time, and it is difficult even for the particularly well-skilled to complete the coating.

An attempt will be considered to use water-based acrylic resin paint (water paint of acrylic resin) instead of epoxy resin, but the water as a solvent evaporates to shrink a coating film at the time of curing of the water-based acrylic resin paint. Thus, it is often found that the appearance of the coating is quite different between the state immediately after coating and the state after curing (at the time of completion).

SUMMARY OF THE INVENTION

An object of the present invention is to provide an improved method of producing a decorative plate.

Another object of the present invention is to provide a new and safe method of producing a decorative plate which can be made quite easily without encountering any trouble or danger of users' skin or eyesight.

A further object of the present invention is to provide a new method of producing a decorative plate which permits to maintain an appearance of the state immediately after coating.

According to the present invention, there is provided a method of producing a decorative plate, comprising the steps of:

- preparing a base plate having thereon a predetermined design,
- applying a water-based acrylic paint along a predetermined design to thereby expand the design three-dimensionally,
- permitting the coated paint to become cured to form a first transparent film portion,
- applying a water-based acrylic paint on the cured transparent film to thereby further expand the film portion three-dimensionally, and
- permitting the expanded film portion to become cured to form a second transparent film portion.

In a preferred embodiment of the invention, the water-based acrylic paint is sprayed through a nozzle having a diameter of 0.4 to 0.5 mm particularly if a portion to be coated is rather small.

DETAILED DESCRIPTION OF THE INVENTION

Figure 1:
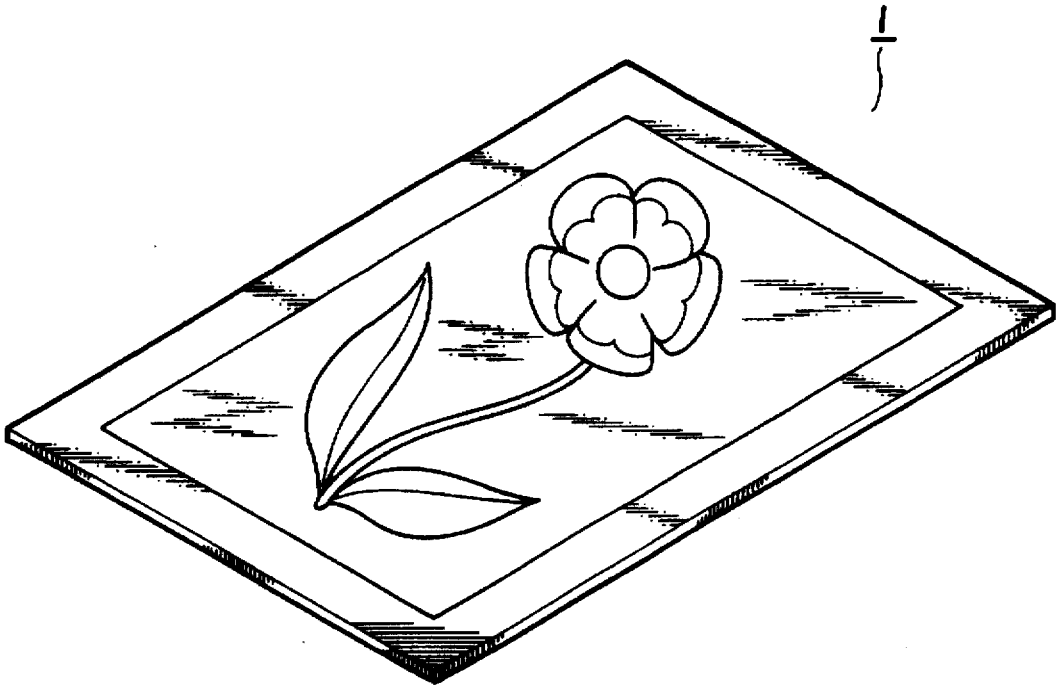
FIG. 1 is a perspective view of a decorative plate which is provide according to the method of the present invention.
Figure 2A:
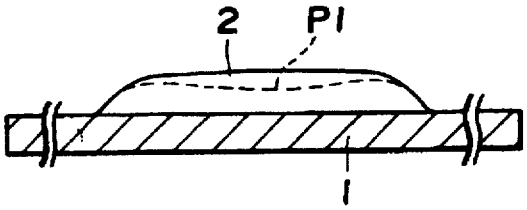
FIG. 2A is a sectional view of the decorative plate showing a step of producing a first film according to the method of the present invention.
Figure 2B:
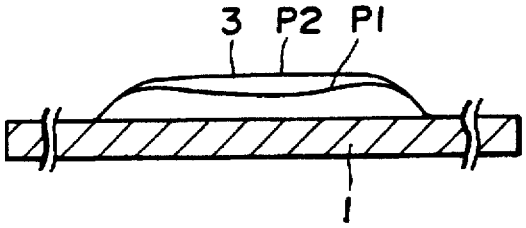
FIG. 2B is a sectional view of the decorative plate showing a step of producing a second film on the first film according to the method of the present invention.

Referring first to FIG. 1, a base plate 1 such as a fabric, cloth, photograph and the like which bears thereon a predetermined design (for example, a flower) is prepared. On the base plate is provided an application of water-based acrylic resin paint 2 along the design of the base plate so that the painted portion is expanded three-dimensionally as shown in FIG. 2A. Specifically, the water-based acrylic resin paint is prepared by adding 45 to 50 wt % of water, 0.5 to 1.0 wt % of ammonia, 1.0 wt % or less of anti-foaming agent and 2.0 wt % or less of nonionic surface active agent to acrylic copolymerization material dispersions (having specific gravity of 1.05 and viscosity of 250–300cP (centapoise). The water-based acrylic resin paint 2 can be coated by the use of brushes in a general manner. For application of the paint to a relatively small area, a nozzle having a diameter of about 0.3–0.5 mm can be used to spray or discharge the water-based acrylic resin paint 2.

The application of the water-based acrylic resin paint 2 onto the base plate is followed by a curing step for a predetermined time. By the curing, water contained in the water-based acrylic resin paint 2 evaporates to cure the water-based acrylic resin paint 2. As shown in FIG. 2A, the first transparent coating film P1 is formed. At this moment, the first transparent coating film P1 shrinks by the water content of evaporation relative to the state of immediately after the application.

After the curing of the water-based acrylic resin paint 2 to form the first transparent film P1 on the base plate, another water-based acrylic resin paint 3 is coated on the first transparent film to expand further the coated portion in a three-dimensional manner and then cured for a predetermined time. A specific method of applying the water-based acrylic resin paint 3 is substantially similar with the step of applying the paint 2 to form the first transparent film P1. Similarly with the step of forming the first transparent film P1, in this step of forming the second transparent film P2, the water contained in the second transparent coating film P2 evaporates to shrink relative to the water-based acrylic resin paint 3 immediately after the application. However, the shrinkage in this step is negligible relative to the volume of the first water-based acrylic resin paint 2 immediately after the application. By the step of curing the second transparent coating film P2, the production of the decorative plate is completed and the first and second transparent films P1 and P2 provide a desired design having a three-dimensional appearance.

As described above, the shrinkage of the first water-based acrylic resin paint 2 is substantially compensated by the application of the second water-based acrylic resin paint 3 and, accordingly, the appearance of the first transparent film P1 by the first water-based acrylic resin paint 2 is maintained to the last, after the completion of the production of the decorative plate. Therefore, with expectation of the appearance of the finished decorative plate, the application of the first water-based acrylic resin paint 2 can be proceeded with.

If needed and/or desired, additional application(s) can be made after the second transparent film P2 is formed and cured so that a shrinkage of the second water-based acrylic resin paint 3 can be compensated by the additional (third) application of the paint.

According to the present invention, water-based paint (that is, a paint which contains water as a solvent) is used and therefore it ensures high safety. In addition, the paint is not of the two-pack type and the preparation of the paint requires no proficiency but can be made quite easily. Further, since shrinkage of the first water-based acrylic resin paint 2 can be compensated by the second water-based acrylic resin paint 3, the original appearance immediately after the coating can be maintained.

What is claimed is:

1. A method of producing a decorative plate comprising the steps of:

preparing a base plate having thereon a design, applying first water-based acrylic paint on the design to thereby provide a design which is expanded three-dimensionally, curing the paint to form a first cured transparent film portion, applying second water-based acrylic paint on the first cured transparent film portion to thereby further expand first cured transparent film portion three-dimensionally, and curing the further expanded three-dimensional film portion to form a second cured transparent three-dimensional film portion on the design on the base plate, wherein the water-based acrylic paint is prepared by adding 45 to 50 wt % of water, 0.5 to 1.0 wt % of ammonia, 1.0 wt % or less of anti-forming agent and 2.0 wt % or less of nonionic surface active agent to acrylic copolymerization material dispersions having specific gravity of 1.05 and viscosity of 250–300 cP.

2. A method of producing a decorative plate according to claim 1, wherein third water-based acrylic paint is applied additionally to the second cured transparent film portion.

* * * * *